US007530885B2

(12) United States Patent
Sun et al.

(10) Patent No.: US 7,530,885 B2
(45) Date of Patent: May 12, 2009

(54) PNEUMATIC GRINDER WITH IMPROVED HANDLE STRUCTURE

(75) Inventors: Yung-yung Sun, Dali (TW); Chuan-ching Cheng, Taichung (TW)

(73) Assignee: Storm Pneumtic Tool Co., Ltd., Taichung County (TW)

( * ) Notice: Subject to any disclaimer, the term of this patent is extended or adjusted under 35 U.S.C. 154(b) by 380 days.

(21) Appl. No.: 11/585,944

(22) Filed: Oct. 25, 2006

(65) Prior Publication Data

US 2008/0102739 A1 May 1, 2008

(51) Int. Cl.
*B24B 23/00* (2006.01)

(52) U.S. Cl. ..... 451/358; 451/344; 451/359

(58) Field of Classification Search ..... 451/344, 451/356, 357, 358, 359, 354
See application file for complete search history.

(56) References Cited

U.S. PATENT DOCUMENTS 5,725,422 A * 3/1998 Leweck ..... 451/359
6,155,916 A * 12/2000 Rudolf et al. ..... 451/344
6,241,594 B1 * 6/2001 Lepold ..... 451/359
7,458,882 B2 * 12/2008 Izmailov ..... 451/344
2003/0087596 A1 * 5/2003 Pellegrin ..... 451/354
2005/0217440 A1 * 10/2005 Koschel et al. ..... 81/490
2006/0025060 A1 * 2/2006 Funk ..... 451/358
2007/0212989 A1 * 9/2007 Henke et al. ..... 451/344

* cited by examiner

*Primary Examiner*—Eileen P. Morgan
(74) *Attorney, Agent, or Firm*—Rosenberg, Klein & Lee

(57) ABSTRACT

A pneumatic grinder with improved handle structure comprising a driving portion, a connecting portion, and a grinding portion wherein the connecting portion has a handle fixing portion at one side thereof that has an accommodating space to receive a pivot element wherein the handle fixing portion has a slot on the top thereof, and further, a handle is fixed with the pivot element by screwing so that the handle can be pivoted along the slot and the grip angle thereof can therefore be adjusted.

2 Claims, 3 Drawing Sheets

PNEUMATIC GRINDER WITH IMPROVED HANDLE STRUCTURE

BACKGROUND OF THE INVENTION

1. Technical Field

The present invention relates to a pneumatic grinder with improved handle structure, and more particularly, to a device for adjusting the grip angle of the handle of a pneumatic grinder.

2. Description of Related Art

It is known that when an operator uses a pneumatic grinder to grind workpieces, through ongoing operation, he has to modify the grip posture at intervals to conform to the required grinding positions and angles. However, a conventional grinder is typically equipped with a fixedly fastened handle and the angle between the handle and machine body is not adjustable. Thus, it may disadvantageously render an operator's discomfort due to improper body postures or even incur occupational injuries. On the other hand, as the handle of such conventional grinder is fixedly fastened and non-adjustable, once it spatially hinders the operator's grinding operation on a workpiece, the only solution is to disassemble it from the machine body to obtain sufficient working space and such a solution in turn enhances the risk of damage caused by improper grip. Therefore, it is the object of the present invention to overcome foresaid problems of a conventional handle of a pneumatic grinder.

SUMMARY OF THE INVENTION

An object of the present invention is to provide an adjustable handle of a pneumatic grinder to conform to the required grinding positions and angles and retain proper operational posture. Thus, the handle device can efficiently facilitate preventing occupational injuries caused by improper grip posture. Also when the disclosed handle device spatially hinders grinding operation, the operator can adjust it to a proper position to eliminate the need to detach, thus reducing the risk of damage caused by an improper grip.

To achieve this and other objects of the present invention, the pneumatic grinder with improved handle structure comprises a driving portion, a grinding portion, and a connecting portion, wherein the connecting portion is further attached by an improved handle structure which comprises:

a handle fixing portion provided at one side of the connecting portion which has an accommodating space and a slot provided on the top thereof;

a packing element comprising a first packing surface on the top thereof, and having the bottom thereof closely fitting the top of the handle fixing portion, and said packing element further including a through hole;

a handle having a second packing surface on the end that closely fits the top of the packing element wherein the second packing surface includes a first threaded portion; and a pivot element deposited in the accommodating space of the handle fixing portion which has a second threaded portion positioned correspondingly to the slot of the handle fixing portion.

DETAILED DESCRIPTION OF THE PREFERRED EMBODIMENT

Figure 1:
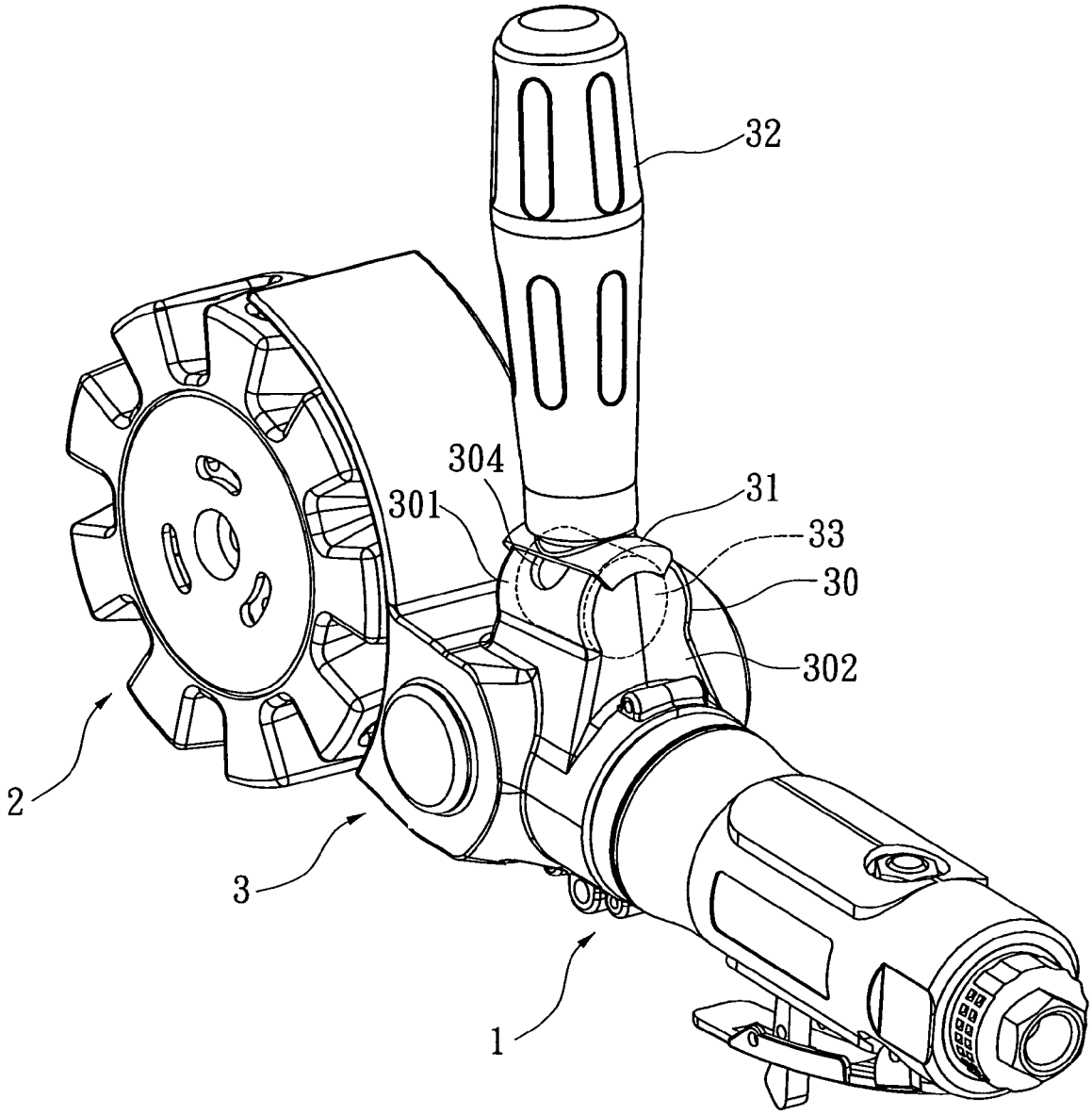
FIG. 1 is a perspective view of a pneumatic grinder with improved handle structure according to the present invention.
Figure 2:
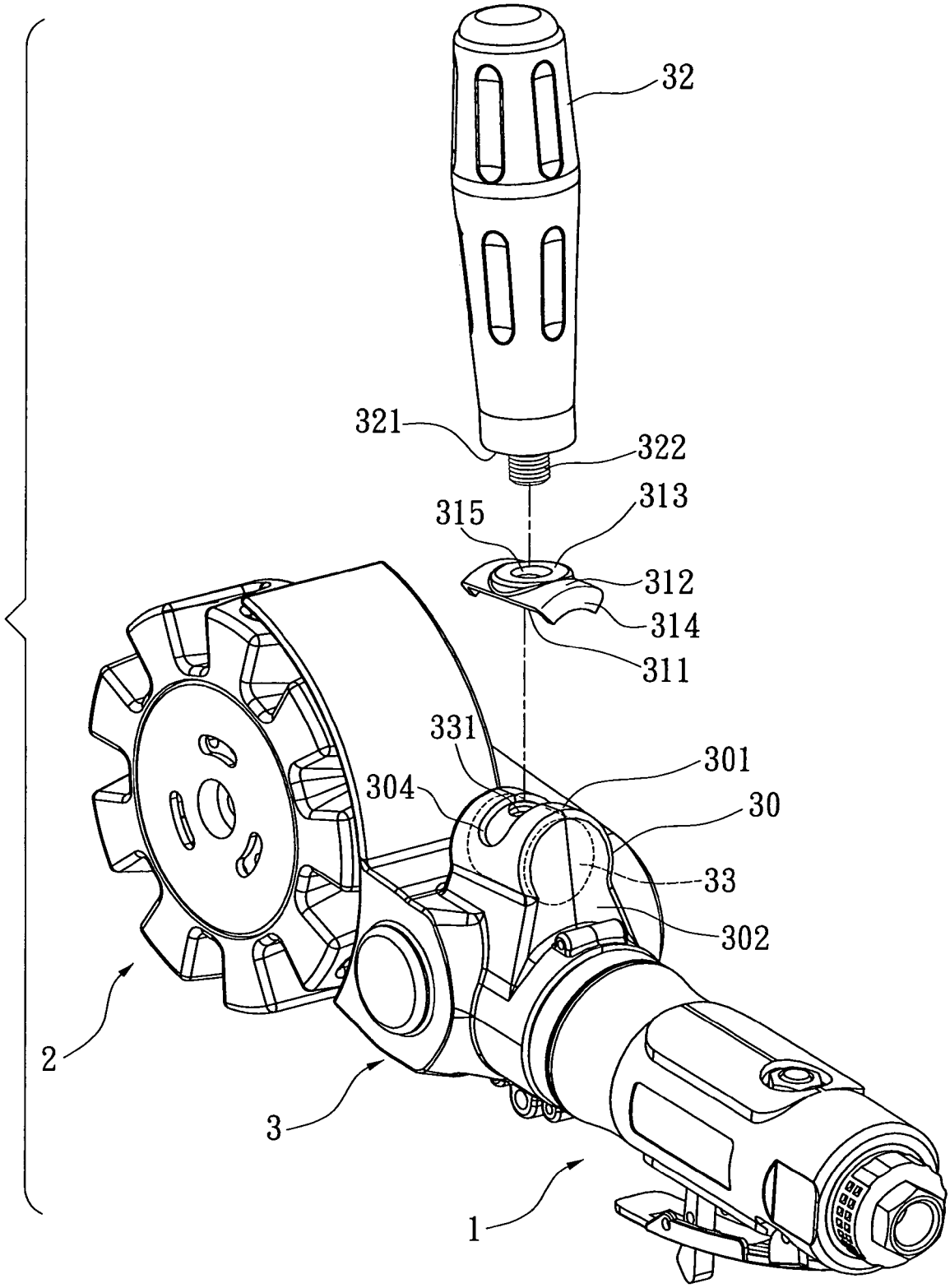
FIG. 2 is an exploded view of the pneumatic grinder with improved handle structure according to the present invention.
Figure 3:
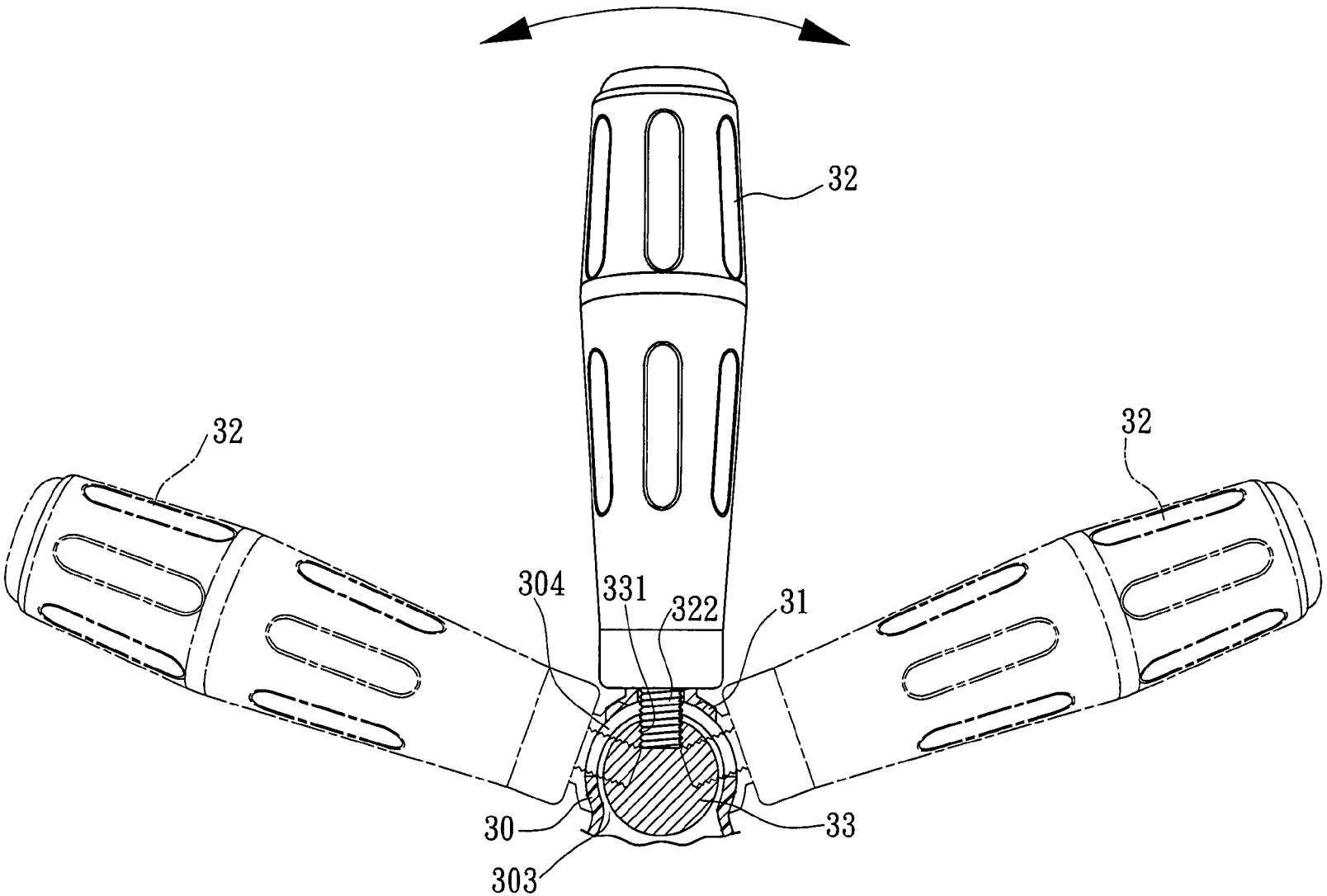
FIG. 3 is an applied view of the handle showing various grip angles.

Please refer to FIGS. 1 to 3, which describe a preferred embodiment of the present invention. It is to be understood that the recited figures and embodiments are for illustration and not intended to limit the structure of the present invention.

According to the present embodiment, it is a pneumatic grinder with an improved handle structure comprising a driving portion 1, a grinding portion 2 and a connecting portion 3 provided therebetween, wherein the connecting portion 3 is formed by two homologous shells fastened oppositely, and has an improved handle structure that comprises:

a handle fixing portion 30 which is provided at one side of the connecting portion 3 and having a curviform top surface 301 wherein the curviform top surface 301 and two sidewalls 302 of the handle fixing portion 30 collectively define an accommodating space 303 wherein the curviform top surface 301 has a slot 304;

a packing element 31 having a bottom 331 as a curviform surface that closely fits the curviform top surface 301 of the handle fixing portion 30; a top 312 which comprises a flat first packing surface 313, two sidewalls 314 located at the two opposite sides of the packing element 31 that fit respectively the two sidewalls 302 of the handle fixing portion 30, and a through hole 315;

a handle 32 having a second packing surface 321 on the end that fits the first packing surface 313 of the packing element 31 wherein the second packing surface 321 includes a protruding first threaded portion 322 that can be an externally threaded bolt according to the particular embodiment of the present invention; and a pivot element 33 deposited in the accommodating space 303 of the handle fixing portion 30 that has a second threaded portion 331 positioned correspondingly to the slot 304 of the handle fixing portion 30 and screwed with the first threaded portion 322 that can be an internally threaded hole according to the particular embodiment of the present invention.

By foresaid components and the relationship thereof, it can be understood that an operator can change the grip angle of the handle 32 (as shown in FIG. 3), by slightly screwing the handle 32 to loosen it from the pivot element 33, and consequently the pressing relationship among the handle 32, packing element 31 and pivot element 33 can be slightly loosened to adjust the pivot element 33 in the handle fixing portion 30 to a desired angle by pivoting the handle 32 thereon, and then screw to tighten the handle 32 and press the first threaded portion 322 of the handle 32 toward the second threaded portion 331 of the pivot element 33. Thereby, the handle 32, packing element 31 and pivot element 33 can be fixed at a desired grip angle.

The major advantage of the present invention is that the disclosed handle device permits an operator to adjust the grip angle of the handle 32 as needed to maintain proper operational posture during grinding thus potential occupational injuries caused by improper grip posture can be eliminated, and, when the disclosed handle 32 spatially hinders the grinding operation, the operator can adjust it to a proper position and there is no more need to detach the handle 32 and this resultantly reduces the risk of damage caused by improper grip.

What is claimed is:

1. A pneumatic grinder with improved handle structure, said grinder comprising a driving portion, a grinding portion and a connecting portion provided therebetween, wherein the connecting portion includes an improved handle structure that comprises:

a handle fixing portion, which is provided at one side of the connecting portion which has an accommodating space, and a slot provided on a top surface thereof;

a packing element, comprising a first packing surface on a top surface thereof, and having a bottom surface thereof for engaging the top surface of the handle fixing portion, and said packing element further including a through hole;

a handle, which has a second packing surface at one end that closely fits the first packing surface on top of the packing element wherein the second packing surface includes a first threaded portion; and a pivot element, which is deposited in the accommodating space of the handle fixing portion and having a second threaded portion at an end corresponding to the slot of the handle fixing portion wherein the handle fixing portion is formed by two homologous shells fastened oppositely and has a curviform top surface and two plate sidewalls relatively located at two sides of the curviform top surface wherein the two flat sidewalls are respectively closely fitted by two flat sidewalls located at opposite sides of the packing element such that tightening the handle into the pivot element causes the two flat sidewalls of the packing element to tighten against the two flat sidewalls of the handle fixing portion.

2. The pneumatic grinder with improved handle structure of claim 1, wherein the first packing surface of the packing element is in a flat form and tightly fastened with the second packing surface of the handle.

* * * * *